US008235710B2

(12) United States Patent
Bloemacher et al.

(10) Patent No.: US 8,235,710 B2
(45) Date of Patent: Aug. 7, 2012

(54) DEVICE AND METHOD FOR CONTINUOUSLY AND CATALYTICALLY REMOVING BINDER, WITH IMPROVED FLOW CONDITIONS

(75) Inventors: Martin Bloemacher, Meckenheim (DE); Johan Herman Hendrik ter Matt, Mannheim (DE); Hans Wohlfromm, Mannheim (DE); Tsung-Chieh Cheng, Heppenheim (DE); Franz-Dieter Martischius, Neustadt (DE); Arnd Thom, Alzey (DE)

(73) Assignee: BASF SE, Ludwigshafen (DE)

( * ) Notice: Subject to any disclaimer, the term of this patent is extended or adjusted under 35 U.S.C. 154(b) by 483 days.

(21) Appl. No.: 11/917,279

(22) PCT Filed: Jun. 7, 2006

(86) PCT No.: PCT/EP2006/062981

§ 371 (c)(1),
(2), (4) Date: Dec. 12, 2007

(87) PCT Pub. No.: WO2006/134054

PCT Pub. Date: Dec. 21, 2006

(65) Prior Publication Data

US 2008/0199822 A1 Aug. 21, 2008

(30) Foreign Application Priority Data

Jun. 13, 2005 (DE) ..... 10 2005 027 216

(51) Int. Cl.
*F27B 15/10* (2006.01)

(52) U.S. Cl. ..... 432/14; 432/148

(58) Field of Classification Search ..... 432/14, 432/17, 140, 148; 219/338, 400, 383
See application file for complete search history.

(56) References Cited

U.S. PATENT DOCUMENTS

| | | | | |
|---|---|---|---|---|
| 5,069,380 | A * | 12/1991 | Deambrosio | 228/42 |
| 5,531,958 | A * | 7/1996 | Krueger | 419/44 |
| 5,573,688 | A * | 11/1996 | Chanasyk et al. | 219/388 |
| 6,045,749 | A * | 4/2000 | Garg et al. | 266/252 |
| 6,283,748 | B1 * | 9/2001 | Orbeck et al. | 432/126 |
| 6,461,156 | B2 * | 10/2002 | Kumazawa et al. | 432/261 |
| 6,629,838 | B1 * | 10/2003 | Van Vuuren et al. | 432/148 |
| 6,780,225 | B2 * | 8/2004 | Shaw et al. | 95/273 |
| 6,936,793 | B1 | 8/2005 | Shiloh et al. | |

FOREIGN PATENT DOCUMENTS

| | | | |
|---|---|---|---|
| DE | 879112 | | 6/1953 |
| DE | 197 19 203 | A1 | 12/1997 |
| EP | 0 978 337 | A2 | 2/2000 |
| JP | 6-122903 | A | 5/1994 |
| WO | WO-00/52215 | A1 | 9/2000 |
| WO | WO-00/79197 | A1 | 12/2000 |
| WO | WO-03/035307 | A1 | 5/2003 |

* cited by examiner

*Primary Examiner* — Gregory A Wilson
(74) *Attorney, Agent, or Firm* — Connolly Bove Lodge & Hutz LLP

(57) ABSTRACT

The apparatus for the continuous catalytic removal of binder from metallic and/or ceramic shaped bodies produced by powder injection molding, which comprises a binder removal furnace through which the shaped bodies pass in a transport direction and are brought to a suitable process temperature, a feed facility for introduction of a process gas which is required for binder removal and comprises a reactant, at least one facility for the introduction of a protective gas into a reaction space of the binder removal furnace and a flare to burn the gaseous reaction products obtained in binder removal, wherein one or more devices which lead to a flow of the process gas directed transversely to the transport direction in the apparatus are present.

21 Claims, 2 Drawing Sheets

DEVICE AND METHOD FOR CONTINUOUSLY AND CATALYTICALLY REMOVING BINDER, WITH IMPROVED FLOW CONDITIONS

PRIORITY

Priority is claimed as a national stage application under 35 U.S.C. §371 to PCT/EP2006/062981 filed Jun. 7, 2006, which claims benefit of German application 10 2005 027 216.9, filed Jun. 13, 2005. The aforementioned priority documents are incorporated herein by reference as if set forth in full.

The invention relates to an apparatus for the catalytic removal of binder from metallic and/or ceramic shape bodies which have been produced by powder injection molding (PIM) and in which a polymer is used as auxiliary for shaping. This is usually a polyoxymethylene (POM) which is removed in a binder removal step after shaping without the shaped bodies themselves changing their shape. In catalytic binder removal from the green shaped parts or green bodies, the polymer used is decomposed into low molecular weight, gaseous constituents under the action of a reactant, e.g. nitric acid in a carrier gas, and under suitable process conditions, in particular in respect of temperature, and these constituents are converted into environmentally acceptable compounds by flaring.

The binder removal step precedes a sintering step and thus influences, in particular in the case of a continuous process, the throughput and the quality which are necessary for the shaped bodies according to their intended use after the sintering step. To ensure quantitative removal of the polymer from the shaped body, the binder removal conditions established are generally maintained for significantly longer than would actually be necessary. This considerably increases the production costs, which are determined, inter alia, by a high consumption of process gas comprising essentially reactants and carrier gas or protective gas.

Catalytic binder removal takes place in the furnace plants in which the green bodies are subjected to an appropriate temperature in a gaseous, acid-comprising atmosphere for a period of time. The construction and the materials of the furnace have to ensure that the temperature in the furnace volume is constant and good heat transfer to the bodies from which the binder is to be removed is achieved. In particular, cold spots in the interior of the furnace plant are to be avoided, so as to prevent condensation of decomposition products. In the case of batch furnaces, internals and circulation elements which ensure a uniform distribution of and turbulence in the process gas in the reaction space so that all green shaped bodies are subject to the same reaction conditions are known from the prior art.

In conventional continuous furnace plants, it has been found that a considerable part of the process gas flows unused as short-circuit stream past the shaped bodies present in a charge into an offgas chimney. Taking off the process gas in the vicinity of the offgas chimney and recirculating it to the gas inlet does not lead to an appreciable improvement in the utilization of the process gas fed in.

Additional introduction of a protective gas stream at the end of the furnace plant in order to achieve improved turbulence in the process gas in the interior of the furnace plant is likewise known. However, the cold protective gas stream introduced leads to such cooling in regions of the furnace plant that undesirable condensation of process materials can occur.

JP-A 06/122903 discloses a process for the removal of binder from metallic shaped bodies under reduced pressure. Here, the shaped bodies are preheated to a particular temperature in a furnace. Gas flow from the furnace wall into the interior to the shaped bodies is produced while the prevailing pressure is simultaneously reduced in steps and the temperature remains constant or increases gradually. An influence is exerted on the cycle times for removal of the binder and on sintering by appropriate choice of the preheating conditions, the gas flow and the alterable furnace pressure. Taking off the gas from the region of the shaped bodies, i.e. essentially from the middle of the interior of the furnace, produces a pressure difference between the furnace wall and the region of the shaped bodies and thus radial, inward-directed flow. This flow prevents condensation or precipitation of the binder on the thermal insulation and the furnace wall, which have an influence on the vacuum.

In continuous catalytic removal of binder, the flow of the process gas in an appropriate apparatus is of particular importance for the efficiency and quality of the binder removal step. It is therefore an object of the present invention to provide an apparatus for the continuous catalytic removal of binder, in which improved flow conditions prevail in a binder removal furnace. In particular, a maximum utilization of the process gas, a minimal short-circuit stream and thus a homogeneous process atmosphere in the binder removal furnace should be achieved, with condensation being prevented at the same time. This would make reliable process conditions and a significantly higher throughput possible in the binder removal furnace.

The achievement of this object starts from an apparatus for the continuous catalytic removal of binder from metallic and/or ceramic shaped bodies produced by powder injection molding, which comprises a binder removal furnace through which the shaped bodies pass in a transport direction and are brought to a suitable process temperature, a feed facility for introduction of a process gas which is required for binder removal and comprises a reactant, at least one facility for the introduction of a protective gas into a reaction space of the binder removal furnace and a flare to burn the gaseous reaction products obtained in binder removal. The apparatus of the invention is then distinguished by one or more devices which lead to a flow of the process gas directed transversely to the transport direction in the apparatus being present.

The apparatus for continuous catalytic binder removal has a binder removal furnace through which the shaped bodies from which the binder is to be removed are transported, for example distributed on transport boxes, in accordance with a suitable residence time.

The transport boxes can be configured so that uniform flow around the shaped bodies from which the binder is to be removed is promoted. For this purpose, it is advantageous for a transport box to have a gas-permeable bottom and gas-permeable sidewalls. In this way, a vertical flow of the process gas through the transport box and a desired transverse inflow are achieved.

An advantageous embodiment of an apparatus for continuous catalytic binder removal is based on the mode of operation of a pulse furnace in which a narrow tunnel cross section can be achieved as a result of the absence of devices for the transport of laden transport boxes. A significant improvement in the utilization of the process gas can be achieved in this way.

In an apparatus for continuous catalytic binder removal, a transport belt generally conveys, in accordance with the required residence time, the transport boxes laden with the shaped bodies from which the binder is to be removed through the binder removal furnace. It is known that forward and return directions of the transport belt are separated from one another by a perforated metal sheet. According to the invention, the perforated metal sheet is replaced by a closed metal sheet over part of or over the entire length of the transport belt. In this way, a short-circuit stream of the process gas directed downward into the region of the transport belt return, which is apparent predominantly in the region of the process gas inlet, is minimized.

Guide plates which are according to the invention provided both in an upper region of the binder removal furnace and in the region of transport belt conveyance advantageously reduce the short-circuit stream of unutilized process gas by reducing the free flow cross section. In addition, they define a flow path of the process gas which is directed largely vertically to the transport direction and thus improve the flow around the shaped bodies from which the binder is to be removed. Guide plates provided in the lower region of the binder removal furnace in which the transport belt runs force vertical upward-directed flow of the process gas through the transport boxes and thus contribute to a homogeneous process atmosphere.

Guide plates provided in the upper region of the binder removal furnace can, according to the invention, be located on the ceiling of the binder removal furnace. Preference is given to the guide plates being arranged on the uppermost layer of the transport boxes laden with shaped bodies, since the height of the charge of shaped bodies from which the binder is to be removed resting on the transport boxes can be varied in this way.

In addition, a perforated partition can be provided between two transport boxes following one another in the transport direction so that the residence time of the process gas per charge is increased further.

According to the invention, one or more circulation devices, for example in the form of fans, distributed uniformly along the binder removal furnace can be present in the apparatus for continuous catalytic binder removal. The circulation devices according to the invention, which are located on only one sidewall of the binder removal furnace or preferably alternately on two opposite sidewalls, result in turbulence in the process gas and thus homogeneous mixing in the interior of the continuous apparatus. At the same time, an efficiency-increasing transverse flow according to the invention of the process gas, relative to the shaped bodies from which the binder is to be removed, is achieved.

An advantageous embodiment provides for one or more points of introduction for the process gas into the binder removal furnace. In particular, a plurality of uniformly distributed points of introduction are advantageous since additional mixing in the interior is achieved in this way. Thus, introduction of the process gas into the binder removal furnace from above at a plurality of points, preferably at high velocity, leads to a favorable vertical flow.

A further preferred embodiment of the apparatus for continuous catalytic binder removal strives for a flow of the process gas which is directed essentially transverse to the transport direction of the shaped bodies resting on transport boxes. For this purpose, the process gas required for binder removal is introduced into the interior of the binder removal furnace via one or preferably more than one points of introduction arranged along the sides. These lateral points of introduction can be uniformly distributed over the entire length of the binder removal furnace or be provided only on one section of this. Here, points of introduction on one side of the binder removal furnace and preferably points of introduction arranged alternately on two opposite sides are conceivable. The points of introduction can be configured as slits, as holes or as nozzles. The process gas which is in this way introduced laterally flows through the transport boxes and thus the shaped bodies from which the binder is to be removed largely transversely to the transport direction.

Such a transverse flow onto the shaped bodies which is achieved by means of the lateral points of introduction of the process gas can be supplemented by circulation devices arranged on one or both sides.

The process gas is preferably taken off at the end of the furnace and recirculated into the feed line which leads to the lateral points of introduction for the process gas. As a result, not only is the unutilized short-circuit stream fed in but efficient utilization of the process gas is achieved by means of the transverse flow onto the shaped bodies.

In a further embodiment, the apparatus for continuous catalytic binder removal comprises facilities for heating the process gas before it enters the furnace, resulting in improved utilization of the process gas.

The apparatus according to the invention for continuous catalytic binder removal can be employed universally for all processes in which removal of binder and/or reaction of substances at the surface of a body take place and in which directed flow is to be achieved so as to optimally utilize the process materials fed in.

Furthermore, the object of the invention is also achieved by a process for the catalytic removal of binder from metallic and/or ceramic shaped bodies produced by powder injection molding, in which the shaped bodies are transported through a binder removal furnace in accordance with a predetermined residence time while they are brought to a process temperature in the range from 100° to 150° C. and the process gas introduced, which comprises a reactant in a carrier gas stream, is brought to an appropriate temperature before it is introduced.

The invention is described in more detail below with the aid of the drawings.

Figure 1:
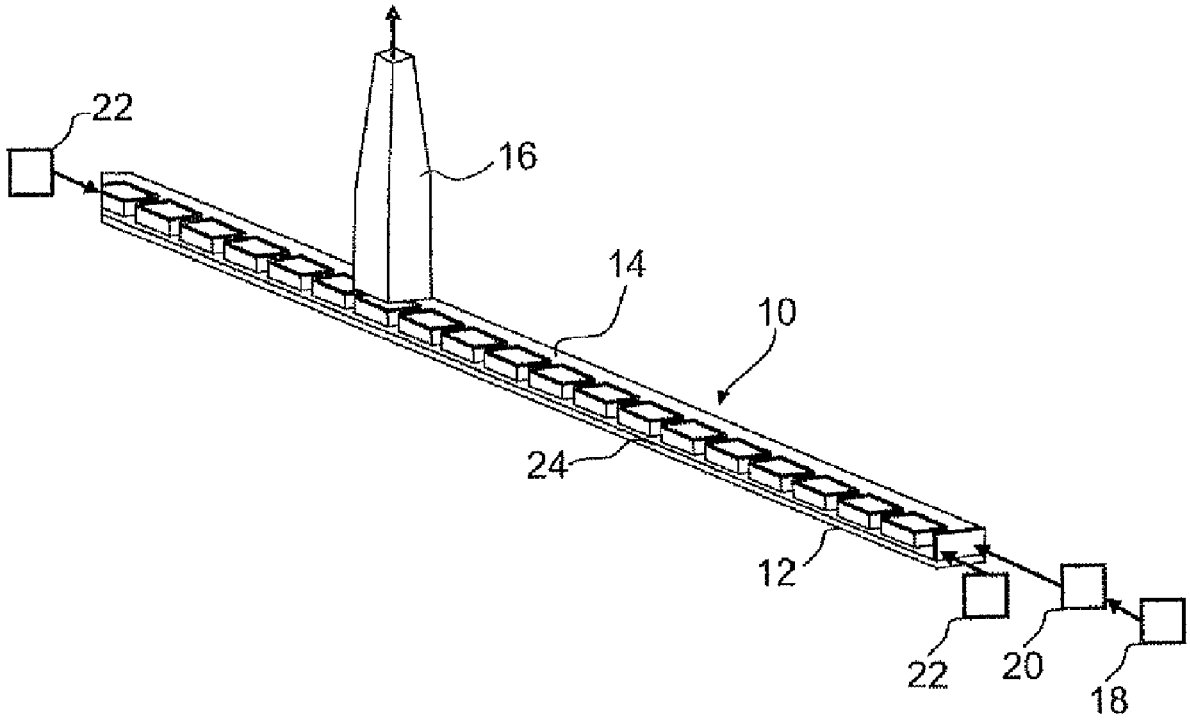
FIG. 1 shows a schematic depiction of the apparatus of the invention.
Figure 2:
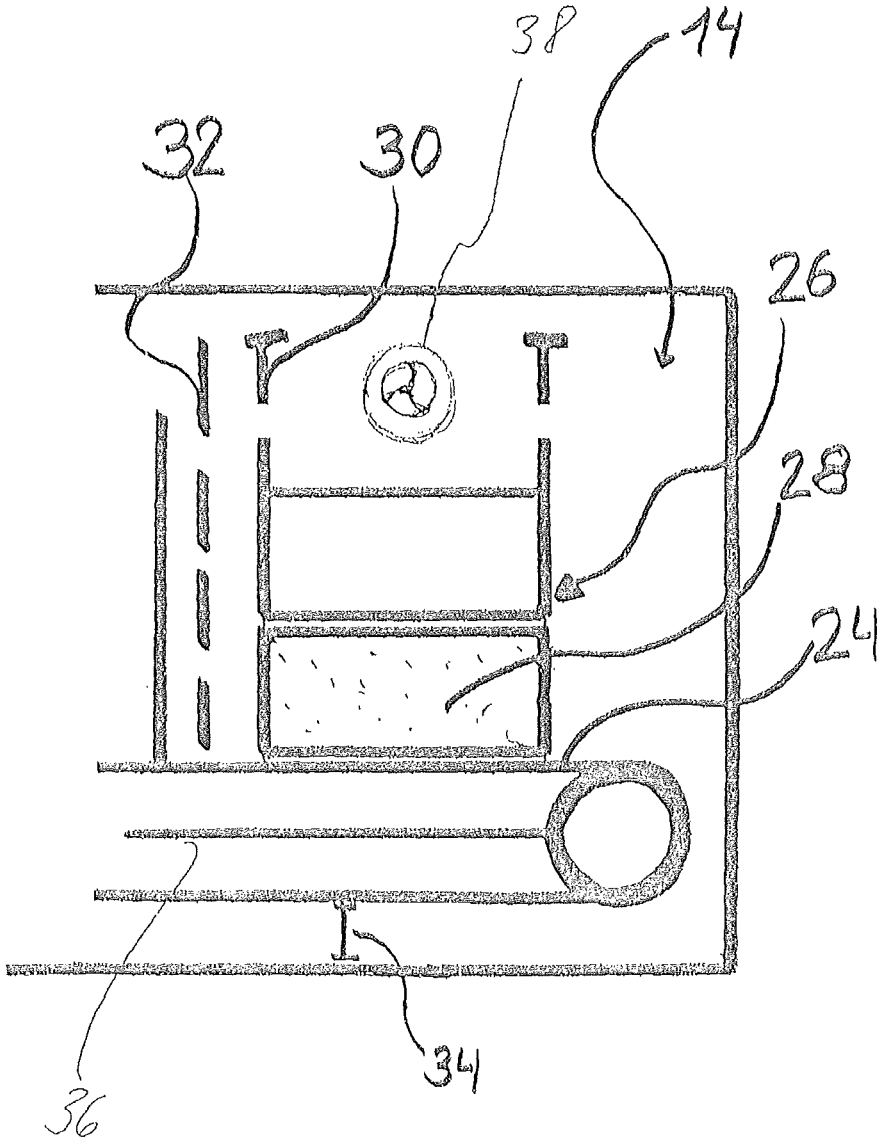
FIG. 2 shows schematic depiction of the reaction space of the apparatus of the invention.

The apparatus of the invention for continuous catalytic binder removal 10 comprises a continuous binder removal furnace 12 which is preferably made of stainless steel. The binder removal apparatus 10 is intended for the purpose of removing binder catalytically from ceramic and/or metallic shaped bodies produced by powder injection molding. This means that a matrix comprising a synthetic polymer, which has made the production of the shaped bodies of a desired shape possible, is to be removed qualitatively from them without the shape of the shaped bodies being altered. The preferred matrix material is based on polyoxymethylene (POM).

Binder removal in the continuous binder removal furnace 12 occurs in a reaction space 14. Heating elements, preferably electric heating elements, not shown in the FIGURE ensure a homogeneous reaction temperature in the reaction space 14, which is preferably in the range from 110° C. to 140° C. Owing to a complex composition of the binder system, careful setting of the temperature is necessary. As reactants in the reaction space 14, use is made of a gaseous, acid-comprising component, e.g. here a high-concentration nitric acid in a stream of carrier gas, e.g. nitrogen, which reacts with the matrix material to depolymerize it and produce monomeric constituents of the matrix material in the gaseous state as end products of the reaction. These constituents are burnt in a flare denoted by 16. During the binder removal step, the reaction space 14 of the binder removal furnace 12 is continually flushed with nitrogen as protective gas.

Liquid nitric acid which is preferably vaporized in an appropriate apparatus directly into the reaction space 14 or in an apparatus 20 located upstream of the binder removal furnace 12, is, for example, introduced into the reaction space 14 by means of a metering pump 18. Typical volume flows of nitric acid in the apparatus of the invention are in the range from 0.2 l/h to 1.5 l/h.

Flushing with the inert gas is carried out via a flow regulating valve 22, preferably both at the entrance and at the exit of the reaction space 14 of the binder removal furnace 12. Typical values of the volume flow of nitrogen are from 0.5 $m^3$/h to 3 $m^3$/h at the entrance into the binder removal furnace and from 6 $m^3$/h to 20 $m^3$/h at the exit.

The quoted volume flows of nitric acid, carrier gas and protective gas are based on a volume of the preferred cuboidal reaction space 14 of typically from 0.3 $m^3$ to 0.6 $m^3$.

The reaction products formed by the depolymerization reaction are converted by combustion in the flare 16 into oxidic substances which can be emitted into the atmosphere without causing problems. The flare 16 is preferably arranged in an upright fashion on the upper side of the binder removal furnace 12.

The shaped bodies 26 from which the binder is to be removed are introduced into the reaction space 14 of the binder removal furnace 12 which is preferably heated by means of electric heating elements. Here, the shaped bodies 26 can, according to the invention, be distributed over transport boxes 28 which are preferably permeable to the process gas at the bottom and at the sidewalls. The transport boxes 28 preferably comprise perforated bottom and in-between metal sheets which allow flow around the charge of shaped bodies located thereon. According to the invention, perforated metal sheets 32 which act as a type of vertical partition can be provided between individual transport boxes or charges which follow one another in the transport direction. This achieves a vertically directed flow path of the process gas and thus improves flow through the transport boxes 28.

The laden transport boxes 28 are preferably transported through the reaction space 14 of the binder removal furnace 12 by means of a transport belt 24. However, an apparatus based on the principle of a pulse furnace can also be used for reducing the cross section of the binder removal furnace. Separation of forward direction and reverse direction of the transport belt 24 by means of a perforated metal sheet is known. However, this perforated dividing sheet leads, particularly at the inlet for the process gas, to an appreciable downward-directed short-circuit stream via which the process gas flows unused toward the outlet. For this reason, the perforated dividing sheet is replaced by a closed metal sheet 36 in regions, in particular in the region of the gas inlet or preferably over the entire length of the reaction space 14. A downward-directed short-circuit stream is reduced in this way.

In the upper region of the reaction space 14, flow paths of the process gas are defined by means of guide plates 30. These guide plates 30 can be installed on the ceilings of the essentially cuboidal reaction space 14. These deflect the process gas and thus increase its residence time, based on a charge located on the transport boxes, and reduce an unutilized short-circuit stream.

Guide plates 30 are preferably arranged on the upper side of the transport boxes, so that the height of the shaped bodies which are located thereon and from which the binder is to be removed can be varied.

To reduce the free flow cross section in the binder removal furnace 12 and thus reduce an unutilized short-circuit stream, guide plates 34 are provided in the lower region of the binder removal furnace 12 in which the transport belt is conveyed so as to force an upward-directed flow path of the process gas.

To achieve a uniform and preferably rapid removal process, a homogeneous temperature distribution within the reaction space 14 and in particular in respect of the shaped bodies is necessary. The reaction products formed by the depolymerization reaction of the matrix material, which concentrate in the environment of the shaped bodies, lead to some adverse effect on the binder removal process and therefore have to be removed uniformly. It is therefore necessary for the process gas to be distributed uniformly and be swirled about in the reaction space 14 so that all shaped bodies are subject to essentially identical reaction conditions. According to the invention, one or more circulation devices 38, in particular blowers or fans, are provided on a sidewall of the binder removal furnace 12 and preferably alternately on two opposite sidewalls of the binder removal furnace 12. This achieves not only a uniform process atmosphere but also transverse flow according to the invention onto the shaped bodies from which the binder is to be removed.

In particular, one or more points of introduction for the process gas which are for reasons of flow dynamics provided on the binder removal furnace promote desired turbulent flow of the process gas and/or advantageous transverse flow onto the shaped bodies from which the binder is to be removed. According to the invention, injection of the process gas from above at high velocity into the reaction space 14 of the binder removal furnace 12, preferably between successive transport boxes, can contribute to turbulent flow of the process gas and thus to homogenization of the process atmosphere.

In particular, transverse flow onto the shaped bodies can be achieved by a lateral introduction according to the invention of the process gas into the binder removal furnace 12. The introduction can occur in regions or preferably be uniformly distributed along the entire length of the binder removal furnace 12. The introduction can be provided along a side of the binder removal furnace 12, preferably at two opposite sides of the binder removal furnace 12, with introduction at two opposite sides of the binder removal furnace 12 preferably occurring alternately. The introduction can be effected via slits, holes or nozzles in the sidewalls of the binder removal furnace 12.

Lateral introduction of the process gas on two opposite sidewalls of the binder removal furnace 12 with points of introduction arranged alternately on opposite sides supplemented by circulation devices 38 on the respective opposite sidewall of the binder removal furnace 12 is particularly advantageous. The mixing in the interior of the reaction space 14 achieved in this way and the transverse flow onto the shaped bodies according to the invention lead to a homogeneous temperature and process gas distribution with simultaneously accelerated removal of reaction products from the environment of the shaped bodies from which the binder is to be removed. The prerequisites for a uniform and accelerated binder removal process are provided in this way.

In the apparatus of the invention for continuous catalytic removal of binder from shaped bodies, the internals and devices used lead to homogeneous mixing in the interior space and a flow path of the process gas which runs essentially transversely to the transport direction. A uniform distribution of the temperature and of the reactant and also removal of reaction products from the environment of the shaped bodies is achieved in this way, so that a process atmosphere which leads to an efficient and shortened binder removal step with a constant high quality of binder removal is created. The lateral introduction according to the invention of the process gas in particular results in a maximum utilization of the process materials used.

The invention claimed is:

1. An apparatus for the continuous catalytic removal of binder from metallic and/or ceramic shaped bodies produced by powder injection molding, the apparatus comprising:

a binder removal furnace through which the shaped bodies are passed in a transport direction, the furnace being adapted to bring the shaped bodies to a suitable process temperature;

a feed facility adapted to introduce a process gas into the binder removal furnace, the process gas comprising a reactant and being adapted to aid in binder removal;

at least one facility adapted to introduce a protective gas into a reaction space of the binder removal furnace;

a flare adapted to burn gaseous reaction products resulting from binder removal;

a transport belt adapted to transport the shaped bodies through the binder removal furnace, wherein the transport belt includes forward and return transport directions, the two directions being separated from one another by a gas-impermeable metal sheet within the binder removal furnace, wherein the gas-impermeable metal sheet minimizes a short-circuit stream of the process gas, wherein the shaped bodies rest on transport boxes having a gas-permeable bottom and gas-permeable sidewalls, and wherein between two transport boxes following in transport direction a perforated partition is provided; and one or more devices, adapted to direct flow of the process gas through the transport boxes transversely to the transport direction, comprising guide plates that are adapted to produce a largely vertically directed flow of the process gas.

2. The apparatus according to claim 1, wherein the one or more devices comprise circulation devices in an interior of the binder removal furnace.

3. The apparatus according to claim 2, wherein a plurality of circulation devices are arranged alternately to one another on opposite walls of the binder removal furnace.

4. The apparatus according to claim 1, wherein the process gas is introduced into the binder removal furnace via a plurality of points of introduction along the transport direction.

5. The apparatus according to claim 4, wherein the plurality of points of introduction are arranged on the sides of the binder removal furnace.

6. The apparatus according to claim 5, wherein the plurality of points of introduction are arranged alternately to one another on opposite walls of the binder removal furnace.

7. The apparatus according to claim 1, wherein the transport belt is adapted to transport the shaped bodies through the binder removal furnace over a predetermined period of time.

8. The apparatus according to claim 7, wherein the predetermined period of time ranges from 2 hours to 8 hours.

9. The apparatus according to claim 1, wherein the suitable process temperature ranges from 100° C. to 150° C.

10. The apparatus according to claim 1, wherein the process gas comprises vaporized nitric acid as the reactant in a stream of nitrogen gas.

11. An apparatus for the continuous catalytic removal of binder from metallic and/or ceramic shaped bodies produced by powder injection molding, the apparatus comprising:

a binder removal furnace through which the shaped bodies are passed in a transport direction, the binder removal furnace being adapted to bring the shaped bodies to a suitable process temperature;

a feed facility adapted to introduce a process gas into the binder removal furnace, the process gas comprising a reactant and being adapted to aid in binder removal;

at least one facility adapted to introduce a protective gas into a reaction space of the binder removal furnace;

a flare adapted to burn gaseous reaction products resulting from binder removal;

a transport belt adapted to transport the shaped bodies through the binder removal furnace, wherein the transport belt includes forward and return transport directions, the two directions being separated from one another by a gas-impermeable metal sheet within the binder removal furnace, and wherein the gas-impermeable metal sheet minimizes a short-circuit stream of the process gas; and one or more devices, adapted to direct flow of the process gas transversely to the transport direction, comprising guide plates that are adapted to produce a largely vertically directed flow of the process gas.

12. The apparatus according to claim 11, wherein the guide plates are provided both in the upper region of the binder removal furnace and in the lower region of the binder removal furnace in which the transport belt runs.

13. The apparatus according to claim 11, wherein the one or more devices further comprise circulation devices in an interior of the binder removal furnace.

14. The apparatus according to claim 13, wherein a plurality of circulation devices are arranged alternately to one another on opposite walls of the binder removal furnace.

15. The apparatus according to claim 11, wherein the process gas is introduced into the binder removal furnace via a plurality of points of introduction along the transport direction.

16. The apparatus according to claim 15, wherein the plurality of points of introduction are arranged on the sides of the binder removal furnace.

17. The apparatus according to claim 16, wherein the plurality of points of introduction are arranged alternately to one another on opposite walls of the binder removal furnace.

18. The apparatus according to claim 11, wherein the transport belt is adapted to transport the shaped bodies through the binder removal furnace over a predetermined period of time.

19. The apparatus according to claim 18, wherein the predetermined period of time ranges from 2 hours to 8 hours.

20. The apparatus according to claim 11, wherein the suitable process temperature ranges from 100° C. to 150° C.

21. The apparatus according to claim 11, wherein the process gas comprises vaporized nitric acid as the reactant in a stream of nitrogen gas.

* * * * *